US005412276A

United States Patent [19]

van Mensvoort

[11] Patent Number: 5,412,276

[45] Date of Patent: May 2, 1995

[54] COLOR DISPLAY TUBE HAVING AN INTERNAL MAGNETIC SHIELD

[75] Inventor: Adrianus J. van Mensvoort, Eindhoven, Netherlands

[73] Assignee: U.S. Philips Corporation, New York, N.Y.

[21] Appl. No.: 34,025

[22] Filed: Mar. 22, 1993

[30] Foreign Application Priority Data

May 15, 1992 [EP] European Pat. Off. ..... 92201386

[51] Int. Cl.[6] ..... H01J 29/06

[52] U.S. Cl. ..... 313/402; 313/479

[58] Field of Search ..... 313/402, 479; 174/35 MS

[56] References Cited

U.S. PATENT DOCUMENTS

| | | | |
|---|---|---|---|
| 4,229,675 | 10/1980 | Matsuki et al. | 313/402 |
| 4,580,076 | 4/1986 | Shimoma et al. | 313/402 |
| 4,622,490 | 11/1986 | Bonway | 313/402 |
| 4,758,193 | 7/1988 | Brown | 313/402 X |

*Primary Examiner*—Donald J. Yusko
*Assistant Examiner*—N. D. Patel
*Attorney, Agent, or Firm*—Robert J. Kraus

[57] ABSTRACT

Color display tube of the 3-in-line type having a display screen with a pattern of phosphor lines. The display tube has an internal shield with two long walls and two short walls. Each long wall is provided with at least one slit extending in the longitudinal direction of the tube and being remote from the edges of the walls, while for locally increasing the magnetic resistance the shield is particularly provided with a short transverse slit between at least one slit end and an edge of the shield.

6 Claims, 3 Drawing Sheets

COLOR DISPLAY TUBE HAVING AN INTERNAL MAGNETIC SHIELD

BACKGROUND OF THE INVENTION

The invention relates to a colour display tube comprising:

an envelope with a longitudinal axis, having a neck portion, a funnel portion and a window portion;

an electron gun arranged in the neck portion;

a display screen having a short axis and a long axis and a pattern of phosphor lines parallel to an axis of the display screen on the inner surface of the window portion;

a colour selection means arranged proximate to the display screen;

a magnetic shielding structure arranged within the funnel-shaped portion, which shielding structure has two long wall portions parallel to the long axis of the display screen and two short wall portions parallel to the short axis of the display screen, and an aperture at its gun-sided end, which aperture extends transversely to the longitudinal axis and constitutes a scanning aperture for electron beams produced by the gun and scanning the display screen.

A colour selection means is herein understood to mean, for example, an apertured shadow mask sheet or a wire mask.

The ratio between the dimension of the long central axis and the dimension of the short central axis of the display screen characterizes the picture format.

In a (colour) display tube the earth's magnetic field deflects the electron paths, which without any measures may be so large that the electrons impinge upon the wrong phosphor line (mislanding) and produce a discolouration of the picture.

Modem display tubes are provided with an internal magnetic shielding structure (shield) to limit the deviation of the electron path due to the earth's magnetic field. A complete shielding is not possible due to an aperture which is required for passing the electron beam. A horizontally directed spot displacement caused by the lateral earth's magnetic produces a risk of discolouration (N effect) in the corners only. The internal residual field can be influenced by means of an additional measure in such a way that the electron beam still passes the mask at the desired angle. This measure involves, for example the use of a shield with "vertically" directed slits (situated in a plane parallel to the short axis of the display screen). The internal residual field is then influenced in such a way that there is less spot displacement in the horizontal direction. The slits enhance the magnetic resistance in the shield material in the horizontal direction so that there is more spot displacement in the vertical direction. However, for picture tubes with phosphor lines extending in this direction this is no problem because it does not lead to discolouration. In the extreme case the shield is split fully magnetically ("split shield"). Overcompensation of the N effect may then even occur.

A problem of "vertically" directed slits is that the slit length is to be limited to ensure the mechanical stability of the shield so that an unacceptable spot displacement remains in the corners, particularly in large tubes. In large tubes having a picture diagonal of 41 cm or more, such as 80 FS ("Flat Square") and 36 inch WS ("Wide Screen") it has been attempted to lengthen the slits to a maximum extent and to restore the resultant loss of mechanical strength by welding on supporting strips of non-ferromagnetic material. However, the following problems then occur.

1. Welding on the strips is a relatively expensive operation,
2. The spot welds are not very reliable (loosening),
3. Oil and grease residues behind the welded strips are difficult to remove (cathode poisoning).

SUMMARY OF THE INVENTION

It is an object of the present invention to provide a display tube of the type described in the opening paragraph, in which the earth's magnetic field is shielded at least as satisfactorily as in the known display tube without, however, detrimentally influencing the mechanical stability of the shield, even in large tubes (with a screen diagonal from 41 cm onwards).

According to the invention, a display tube of the type described in the opening paragraph is therefore characterized in that each of the long wall portions of the shielding structure has at least one elongated aperture extending transversely to the longitudinal direction of the wall and being remote from the edges of the wall, the magnetic resistance of the wall being locally higher than at both sides of the aperture between at least one end of the aperture and the adjacent edge of the wall.

Within the scope of the invention, the magnetic resistance of the wall for the lateral field can be increased in different ways, for example, by local deformation (by means of a centre punch or a laser beam) in the area between the aperture and the edge;

local diffusion of a non-magnetic material, such as aluminium suitable for use in an evacuated space, in the area between the aperture and the edge.

A very effective measure appears to be the provision of a transverse slit between at least one end of the elongate aperture and the adjacent edge of the wall.

This can be realised by T-shaped widening of the elongate aperture at one end, but it is mechanically more favourable to provide a separate transverse slit. A transverse slit may be provided at the gun side, at the display screen side or at both sides of the slit-shaped aperture. The effect is greatest at the display screen side because this is closest to the location where influence should be exerted on the electron beam.

The effect of the measures according to the invention is enhanced if the shield is made of a sheet material.

BRIEF DESCRIPTION OF THE DRAWING

These and other aspects of the invention will be apparent from and elucidated with reference to the embodiments described hereinafter. In the drawing.

DESCRIPTION OF THE PREFERRED EMBODIMENTS

Figure 1:
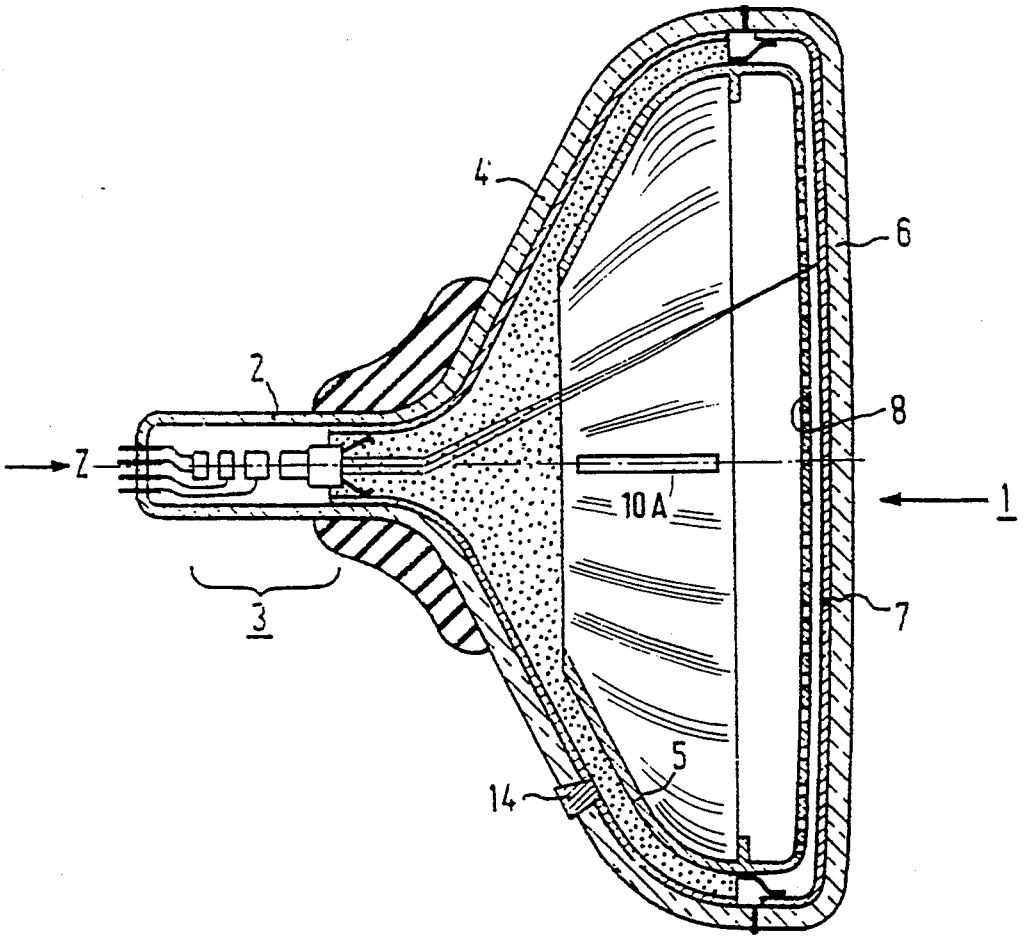
FIG. 1 is a longitudinal sectional view of a colour display tube.

FIG. 1 shows a colour display tube 1 having a glass envelope which comprises a neck portion 2 accommodating an electron gun system 3, a funnel-shaped portion 4 within which a magnetic shield 5 is arranged, and a window portion 6 whose inner surface is provided with a display screen 7 having a pattern of phosphors arranged along parallel lines. A shadow mask 8 is arranged opposite the display screen 7.

The shape of the magnetic shield 5 in display tube 1 roughly follows the contours of the funnel-shaped portion.

Modem display tubes are provided with an internal magnetic shield to reduce the deviation of the electron path due to the earth's magnetic field. A complete shielding is not possible due to the apertures required for the electron beams. In a lateral field only the horizontally directed spot displacement in the corners causes a risk of discolouration (N effect).

The internal residual field is influenced via an additional measure in such a way that the electron beam still passes through the mask at the desired angle.

Figure 2A:
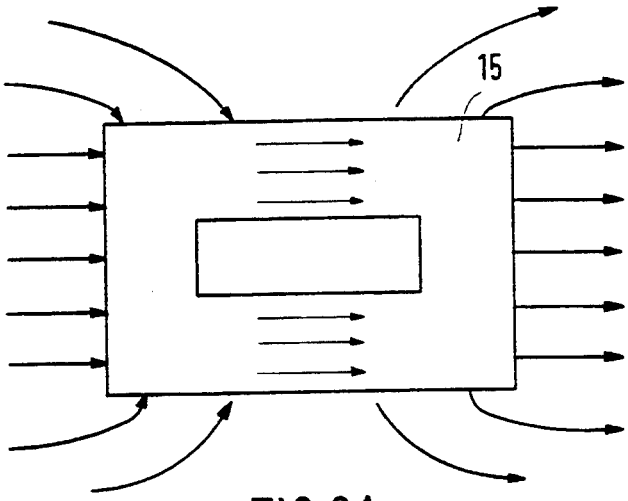
FIGS. 2A to 2F are diagrammatic representations to illustrate the beam mislandings on the display screen due to the earth's magnetic field for different shields.

FIG. 2A shows an example of a shield 15 in a rear view, in which no residual field correction is realised.

Figure 2B:
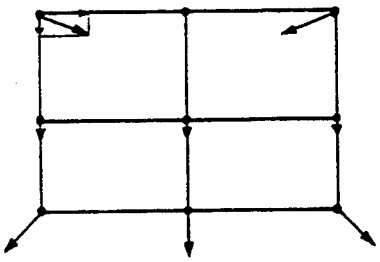

FIG. 2B shows the associated spot displacement in the corners, similarly as in a lateral earth's magnetic field.

Figure 2C:
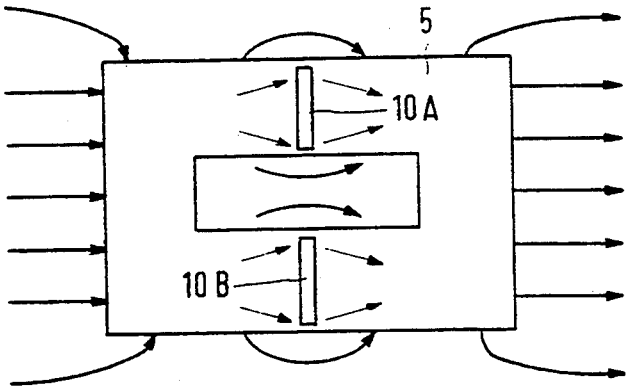
Figure 2D:
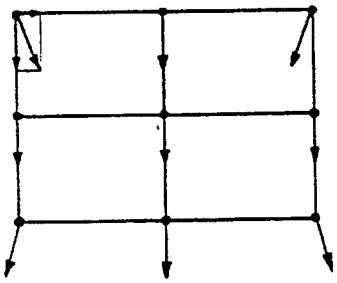

FIG. 2C shows a shield 5 with vertically directed slits 10*a*, 10*b*. The internal residual field is influenced thereby in such a way that there is less spot displacement in the horizontal direction. The slits increase the magnetic resistance in the shield material in the horizontal direction so that there is more spot displacement in the vertical direction (FIG. 2D). However, this is not important for line tubes because it does not cause discolouration.

Figure 2E:
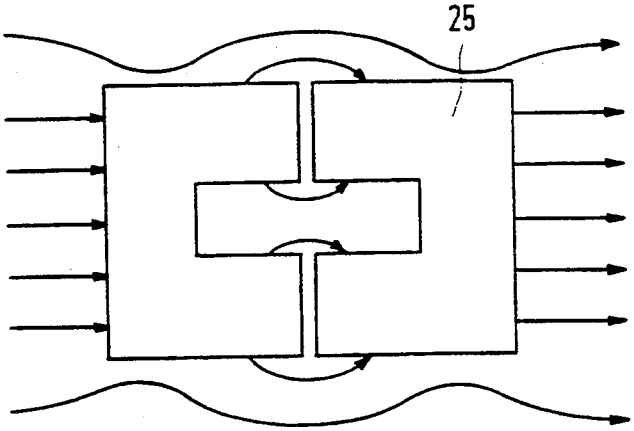
Figure 2F:
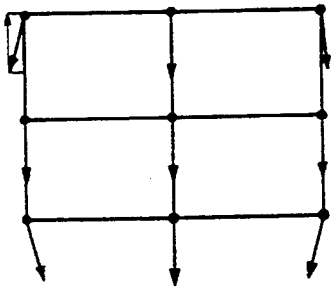

FIG. 2E shows the shield 25 split completely magnetically. Overcompensation of the N effect may even occur in this case (see FIG. 2F).

A problem of the vertically directed slits is that the slit length is to be limited to ensure the mechanical stability of the shield so that an unacceptable spot displacement remains in the corners, particularly in large tubes. When the slits are further extended, the mechanical stability can be restored by welding on supporting strips of a non-ferromagnetic material. However, the previously mentioned problems then occur.

Within the scope of the invention, the slits are not extended any more than is justified in connection with the mechanical stability of the shield and the magnetic resistance for the lateral field in alignment with the afore-mentioned vertically directed slits is enhanced by increasing the path length of the field lines by increasing the iron, and/or by locally degrading the magnetic properties of the material of the shield.

Figure 3A:
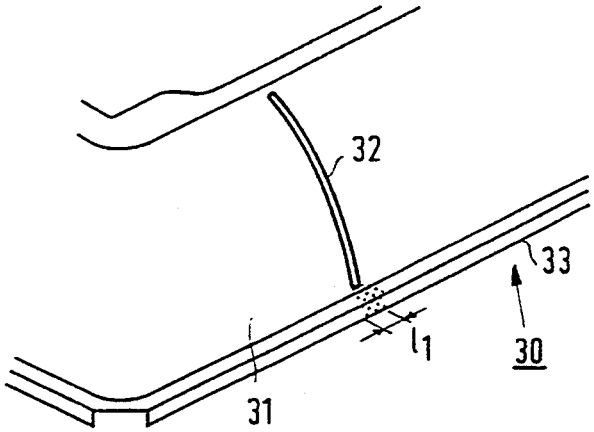
FIG. 3A is a partial elevational view of a first embodiment of an internal shield.
Figure 3B:
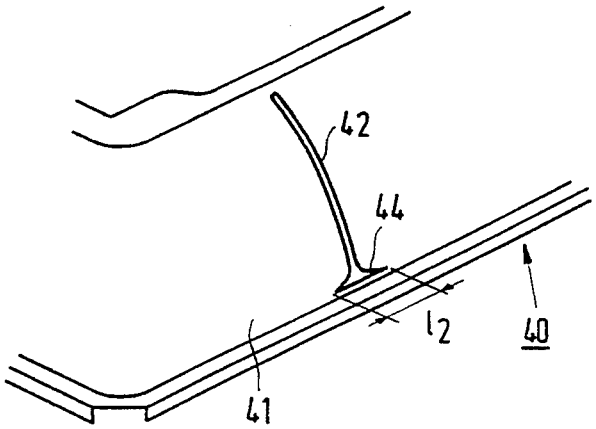
FIG. 3B is a partial elevational view of a second embodiment of an internal shield.

FIGS. 3A to 3B show some embodiments. Their use is attractive in all "line" tubes with a screen diagonal from 41 cm onwards, particularly in tubes having an aspect ratio of more than 4:3, such as 14:9 and 16:9.

FIG. 3A is an elevational view of a corner portion of a shield 30 having a long side wall 31 provided with an elongate transverse aperture, or slit 32. In the area between one end of the slit 32 and the edge 33 of the wall 31 the magnetic properties of the shield material are degraded over a length $l_1$ by means of a special treatment. This treatment may be a mechanical deformation (for example, by means of a centre punch) or a deformation by means of a laser beam, or diffusion of a non-magnetic material (for example, Al). Instead of one slit, a shield with two (or more)—particularly shorter—slits 62, 62' can be used in this embodiment (FIG. 3D).

FIG. 3B is an elevational view of a corner portion of a shield 40 having a long side wall 41 in which a "vertical" slit 42 is provided. To increase the path length of the magnetic field lines, slit 42 is provided with a T-shaped end 44 in which the cross-piece of the T has a length $l_2$ of several tens of millimeters (for example, 40).

Figure 3C:
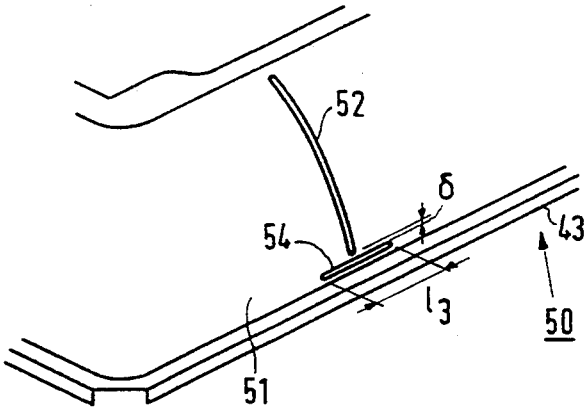
FIG. 3C is a partial elevational view of a third embodiment of an internal shield.
Figure 3D:
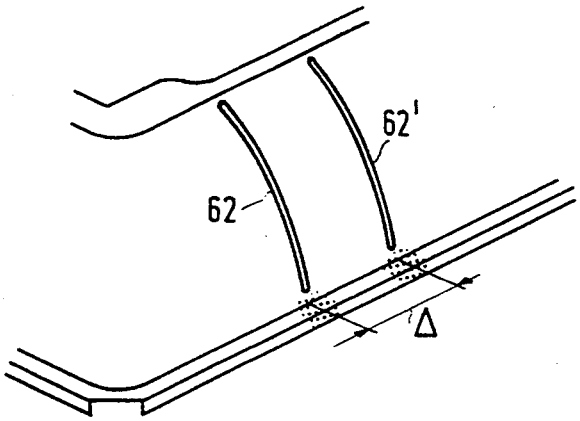
FIG. 3D shows a fourth embodiment of a shield.

FIG. 3C is an elevational view of a corner portion of a shield 50 having a long side wall 51 in which a "vertical" slit 52 is provided. To increase the path length of the magnetic field lines, an auxiliary slit 54 having a length $l_3$ of several tens of millimeters (for example, 40 to 80) and a width of several millimeters (for example, 3) is arranged transversely to the slit 52 between one end of the slit 52 and the edge 43.

The length (i.e. the dimension transverse to the axis of the vertical "major" slits) of the transverse slits is smaller than the length of the "vertical" slits in all these cases. This is favourable for the mechanical stability of the shield.

The shield may be formed from one part or, for example, from two parts (cf. 2E). In the latter case the two shield parts (which are U-shaped in that case) may be fixed to each other in such a way that the afore-mentioned elongate aperture, or apertures is, or are formed at the area of fixation.

I claim:

1. A color display tube comprising:

a. an envelope disposed around a longitudinal axis and including a neck portion, a funnel-shaped portion and a window portion;

b. a display screen supported on the window portion, said screen having a long direction and a short direction transverse to the long direction and comprising a pattern of phosphors for luminescing in different respective colors;

c. an electron gun disposed in the neck portion for producing at least one electron beam for deflection across the display screen;

d. a color selection means disposed proximate the display screen; and e. a magnetic shielding structure disposed within the funnel-shaped portion of the envelope for shielding the at least one electron beam from deflection effects of an external magnetic field, said structure having opposed long walls extending substantially in the long direction of the display screen, opposed short walls extending substantially in the short direction of the display screen, said long and short walls having respective first edges collectively defining an electron beam entrance opening facing the electron gun and having respective second edges collectively defining an electron beam exit opening facing the display screen;

the magnetic shielding structure including means for influencing a portion of the external magnetic field propagated in said structure, said means comprising:

i. at least one elongate aperture formed in each of the opposed long walls, said aperture extending transversely to the long direction; and ii. means for resisting the propagation of said portion of the external magnetic field through a portion of the magnetic shielding structure located between one end of said elongate aperture and a respective one of said first or second edges.

2. A color display tube as in claim 1 where the means for resisting is located between said one end of the elongate aperture and the second edge of the respective long wall in which said elongate aperture is formed.

3. A color display tube as in claim 1 or 2 where the means for resisting comprises an elongate opening extending in the long direction.

4. A color display tube as in claim 3 where the elongate opening has a shorter length than the elongate aperture.

5. A color display tube as in claim 1 or 2 where the means for resisting comprises at least one deformation in said portion of the magnetic shielding structure.

6. A color display tube as in claim 1 or 2 where the means for resisting comprises a non-magnetic material incorporated at said portion of the magnetic shielding structure.

* * * * *